US011395392B2

(12) United States Patent
Squillace et al.

(10) Patent No.: US 11,395,392 B2
(45) Date of Patent: Jul. 19, 2022

(54) MONITOR DEVICE FOR A LIGHTING ARRANGEMENT, A DRIVER USING THE MONITORING ARRANGEMENT, AND A DRIVING METHOD

(71) Applicant: SIGNIFY HOLDING B.V., Eindhoven (NL)

(72) Inventors: Jorge Gabriel Squillace, Eindhoven (NL); Joris Hubertus Antonius Hagelaar, Nuenen (NL); Aleksandar Sevo, Eindhoven (NL); Lucas Louis Marie Vogels, Herten (NL); Marcel Van Der Ham, Eindhoven (NL)

(73) Assignee: SIGNIFY HOLDING B.V., Eindhoven (NL)

( * ) Notice: Subject to any disclaimer, the term of this patent is extended or adjusted under 35 U.S.C. 154(b) by 0 days.

(21) Appl. No.: 16/973,744

(22) PCT Filed: Jun. 6, 2019

(86) PCT No.: PCT/EP2019/064796
§ 371 (c)(1),
(2) Date: Dec. 9, 2020

(87) PCT Pub. No.: WO2019/238527
PCT Pub. Date: Dec. 19, 2019

(65) Prior Publication Data

US 2021/0259077 A1 Aug. 19, 2021

(30) Foreign Application Priority Data

Jun. 14, 2018 (EP) ..... 18177760

(51) Int. Cl.
*H05B 45/24* (2020.01)
*H05B 45/325* (2020.01)
(Continued)

(52) U.S. Cl.
CPC ..... *H05B 45/46* (2020.01); *H05B 45/24* (2020.01); *H05B 45/325* (2020.01); *H05B 45/355* (2020.01)

(58) Field of Classification Search
CPC ..... H05B 45/10; H05B 45/14; H05B 45/24; H05B 45/30; H05B 45/325; H05B 45/355;
(Continued)

(56) References Cited

U.S. PATENT DOCUMENTS 7,471,051 B1 * 12/2008 Wacknov ..... H05B 47/185 315/291
8,581,521 B2 * 11/2013 Welten ..... H05B 47/19 315/312
(Continued)

FOREIGN PATENT DOCUMENTS

WO 2017041999 A1 3/2017

*Primary Examiner* — Thai Pham
(74) *Attorney, Agent, or Firm* — Daniel J. Piotrowski

(57) ABSTRACT

A monitor device is provided for monitoring a lighting arrangement of lighting elements of unknown electrical load, and a driver using the monitoring arrangement. A set of duty cycles is applied to switches which control sub-sets of lighting elements thereby to create a desired light output. With this desired duty cycle setting, the current for an individual duty cycle period is monitored, in particular to detect variations in a current plateau level within the individual duty cycle period. This is used to determine electrical characteristics or parameters including at least a cable resistance between a power supply unit and the lighting arrangement. A power consumption of the lighting arrangement may then be obtained. This avoids the need to probe the sub-sets of lighting elements individually in order to determine the nature of the load and its power consumption.

15 Claims, 7 Drawing Sheets

(51) Int. Cl.
*H05B 45/46* (2020.01)
*H05B 45/355* (2020.01)

(58) Field of Classification Search
CPC .... H05B 45/37; H05B 45/3725; H05B 45/46; H05B 45/52; H05B 45/00
See application file for complete search history.

(56) References Cited

U.S. PATENT DOCUMENTS

| | | | | |
|---|---|---|---|---|
| 2010/0039043 | A1 | 2/2010 | Wacknov et al. | |
| 2011/0043125 | A1* | 2/2011 | Peeters | H05B 45/3725 315/287 |
| 2011/0084620 | A1* | 4/2011 | Lee | H05B 45/10 315/186 |
| 2012/0200229 | A1* | 8/2012 | Kunst | H05B 45/3577 315/186 |
| 2015/0137679 | A1 | 5/2015 | Owen | |
| 2017/0006680 | A1 | 1/2017 | Beijer et al. | |
| 2018/0063928 | A1 | 3/2018 | Hick | |
| 2018/0070417 | A1 | 3/2018 | Galvano et al. | |
| 2018/0249544 | A1* | 8/2018 | Hagelaar | H05B 45/10 |
| 2020/0205259 | A1* | 6/2020 | Hagelaar | H05B 45/14 |

* cited by examiner

MONITOR DEVICE FOR A LIGHTING ARRANGEMENT, A DRIVER USING THE MONITORING ARRANGEMENT, AND A DRIVING METHOD

CROSS-REFERENCE TO PRIOR APPLICATIONS

This application is the U.S. National Phase application under 35 U.S.C. § 371 of International Application No. PCT/EP2019/064796, filed on Jun. 6, 2019, which claims the benefit of European Patent Application No. 18177760.8, filed on Jun. 14, 2018. These applications are hereby incorporated by reference herein.

FIELD OF THE INVENTION

This invention relates to a monitor device for monitoring a lighting arrangement and in particular in which the lighting load is unknown, for example because it is configurable by an end-user. The monitoring may then be used as part of driving of the lighting arrangement, thus being part of a controller or driver.

BACKGROUND OF THE INVENTION

There is a desire to be able to connect different lighting configurations to a standard driver design.

For scalability reasons in lighting systems in which the load may vary, it is beneficial to work with a voltage architecture instead of a current source architecture. The lighting arrangement, such as LED modules, are arranged in parallel with the voltage bus and locally generate the current required for the LEDs used.

An example of such a system that is widely used is a LED strip. A LED strip or LED tape is a linear LED system in which the LEDs are placed on a flexible substrate that can be several meters in length. As opposed to rigid linear systems such as a tubular LED (TLED), this flexibility allows the end-user to apply the strip on non-flat surfaces or to bend it (multiple times) around an angle. Moreover, no installation of a dedicated socket for the LED strip is needed and the strip can be extended and cut to the appropriate length. Because of this ease of installation, LED strips are expected to gain market share over other linear systems in the consumer segment.

Of course, in addition to LED strips, there are other lighting systems possible with end-user changeable loads, such as track lighting or recessed spot lighting.

The typical LED strip architecture is depicted in FIG. 1 as lighting strip 2. The overall lighting system consists of an AC/DC voltage source 10 that transforms the AC mains input voltage 12 into a safe DC voltage output, for example 12V or 24V or any other safe DC voltage. Often a controller 14 is added that is able to receive and apply the color point and dimming level desired by the end user. This control is typically obtained by putting switches 16 in series with the lighting strip 2 that are PWM controlled by the controller 14.

The switches 16 form a set of switches, each of which is for connection to a sub-set of the lighting elements (known as "channels").

The lighting strip may be extended by additional strips 4 or it may even be cut to a shorter length, to suit the requirements of the final application.

The disadvantage of such a voltage-based lighting system is that the lighting load can draw more current than the rated power of the power supply. If the end-user or luminaire installation customer has the freedom to add LED load to the same power supply and the system needs to be able to continue working in case of over loading of the power supply unit, it is desirable for the system to probe the lighting load attached.

This probing can be done by switching on the different channels in the system one by one and measuring their current contribution. However, this results in visual flashing. Moreover sudden load steps might result in voltage dips of the power supply. In some voltage-based systems, a dip in voltage translates into a dip in current and hence the current is not well probed and the actual power is then not estimated correctly. This is only possible if the voltage and current is measured at the same time. Measuring current while not having a constant DC voltage of e.g. 24V (while assuming it is a fixed value of 24V) causes a measurement error.

There is therefore a need for a driver which enables the lighting load to be probed without these disadvantages.

In some designs, the driver architecture comprises a separate power supply unit (PSU), modulator (i.e. a load driver) and LED load. The modulator may be located at a distance from the PSU, and the LED load may be located at a distance from the modulator. There may for example be cables of more than 10 m. There are non-negligible losses in the cables which also need to be taken into account when determining the suitable drive levels to avoid exceeding the rated power of the power supply unit.

SUMMARY OF THE INVENTION

The invention is defined by the claims.

According to examples in accordance with an aspect of the invention, there is provided a monitor device for monitoring a lighting arrangement of lighting elements of unknown electrical load, wherein the lighting arrangement is associated with a switch arrangement for coupling a DC voltage originating from a power supply unit to the lighting arrangement, wherein the switch arrangement comprises a set of switches, each of which is for connection to a sub-set of the lighting elements, wherein the monitor device comprises:

a controller for providing control signals for controlling the switch arrangement using pulse width modulation, wherein the controller is adapted to:

apply a set of duty cycles to the set of switches at the same time thereby to create a user-selected light output;

monitor the current at a plurality of times within an individual duty cycle period thereby to detect a plurality of current plateaus within the duty cycle period;

determine electrical characteristics or parameters of the lighting arrangement and of the power supply unit including at least a cable resistance between the power supply unit and the lighting arrangement and a power consumption downstream of the power supply unit based on the detected current plateaus and the set of duty cycles; and control the lighting arrangement based on the determined electrical characteristics or parameters.

This monitoring device is able to determine the characteristics of the load using at least a cable resistance between a power supply unit and the lighting arrangement, so that the power consumption can be determined and also without individually driving each sub-set of lighting elements. The cable resistance is used in the determination of the power consumption downstream of the power supply unit.

These characteristics or parameters are then used to control the lighting arrangement. An overall current is monitored with all of the lighting elements set to the user-defined desired levels. By monitoring at the time scale of an individual duty cycle period, a connected driver can react fast enough to a detected overload to prevent automatic shut off the DC voltage source. Multiple current plateaus will arise within each duty cycle period because different sub-sets of lighting elements will typically have different duty cycles. Thus, at different times within the overall duty cycle period, different combinations of currents will be drawn, giving rise to different current plateaus. The overall duty cycle period is the same for all of the sub-sets of lighting elements. The plateau measurements enable the average current (or power) to be determined without any visual artifacts. The plateau data can also be used to determine the contribution of each channel. Thus, if the system has a transition from one color point to another, for example, it can be predicted if an over power event will occur, based on knowledge of the current that each channel draws and the new duty cycles. The user-selected output is for example a color and brightness.

The DC voltage means that voltage driving rather than current driving is used, for example it is received from an AC/DC converter.

By taking account of at least a cable resistance between the power supply unit and the lighting arrangement (for example between the power supply unit and a lighting driver), the overall power consumption of downstream of the power supply unit may be more accurately determined. The power required to be supplied by the power supply unit to operate the lighting arrangement with desired duty cycles can then be determined accurately, so that it can be ensured that too much power is not drawn from the power supply unit and/or that the duty cycle settings correctly match a desired light color output.

The electrical characteristics or parameters may comprise a cable resistance between the power supply unit and a lighting arrangement driver.

The electrical characteristics or parameters may further comprise a series resistance of each sub-set of lighting elements.

This enables the power consumption to be determined even more accurately.

Note that these electrical characteristics or parameters do not need to be provided as an output from the device. Instead, they are intermediate values used in determining the output power from the power supply unit more accurately.

The power consumption may be determined based on the known duty cycles applied to the different sub-sets of lighting elements. This requires knowledge not only of a single maximum current but multiple current plateau levels which are each combinations of currents of different sub-sets of lighting elements being driven.

The power consumption determination may be performed at power-on of the lighting arrangement. It may also be performed each time a new set of duty cycles (i.e. a new diming level or color point) is to be applied. It may also be performed whenever changes are detected that indicate that a new determination may be appropriate, for example if a measured actual power consumption deviates from a determined expected power consumption.

By monitoring the current at a plurality of time points within the duty cycle period multiple plateaus can be observed. When different sub-sets of lighting elements have different duty cycles, there are different current flows within each individual duty cycle period.

It is preferable to measure as many plateau values as possible, so that the contribution of each sub-set of lighting elements to the total power can be identified.

For example, in a three channel system there will be three unknown contributions. Three equations are needed to enable the currents to be resolved based on knowledge of the ratios of contributions of the different LED channels. The controller will have information from the LED arrangement since this is needed to be able to calculate a desired duty cycle ratio to obtain a certain color point. Thus, calibration settings are already available which enable the nominal current ratios between the different channels to be derived.

The more plateaus that can be measured, the more accurate the power monitoring result will be.

The monitor device may be provided between an existing driver and a lighting arrangement, in which the existing driver includes the switch arrangement and even the controller. The monitor device may then be provided as a software upgrade to alter the way an existing driver controller is used. Alternatively, the monitor device may be implemented as part of a new driver.

The controller may be adapted to determine the current flowing through each sub-set of lighting elements based on an analysis of the set of different current plateau levels. The controller will be able to do this if a sufficient number of different current plateau values have been measured.

Thus, by detecting current plateaus, different current readings may be interpreted, with the knowledge of the applied duty cycles, to extract the currents through the individual sub-sets of lighting elements. Thus, the total power consumption may be obtained without actually measuring the individual currents through the sub-sets. This is basically achieved by solving a set of simultaneous equations once sufficient current measurements are obtained.

The controller may be adapted to set a maximum duty cycle for each duty cycle of the set based on the determined power consumption of the load and a load rating of the driver. Thus, the power to be provided to the lighting load is kept below a maximum power delivery of the driver, by scaling back the duty cycles of the drive signals, but typically maintaining the desired duty cycle ratio between different channels.

The controller may be adapted to:

monitor the current for a set of sequential individual duty cycle periods; and determine an average current for each detected plateau over the set of sequential duty cycle periods; and determine the power consumption from the average currents.

By taking average current levels over multiple duty cycle periods, the current sensing accuracy is improved.

The controller may be adapted, in a start-up phase, to:

apply a first set of duty cycles which is a scaled down version of a desired set of duty cycles and monitor the current for an individual duty cycle period; and progressively increase the scaling of the set of duty cycles.

When measurements are taken from multiple duty cycles there is a risk that the power can be too high while the measurements are being collected. By progressively scaling up the duty cycles, a moving average can be taken, and it can be detected when the moving average current is approaching a level which exceeds the maximum power delivery. During a voltage glitch it is also possible to measure both voltage and current and predict what the current would be if the voltages rises from a lower voltage to the normal voltage level.

The controller may be adapted, in a monitoring phase after the start-up phase, to determine the electrical characteristics or parameters.

The start-up phase is thus used for ramping up power and ensuring the power supply unit power is not exceeded. Subsequently, the electrical characteristics and parameters are obtained in a monitoring phase.

The controller may be adapted to monitor the actual power over time, and to reapply the start-up phase and/or measurement phase when the monitored actual power exceeds a threshold relating to a maximum rated power. In this way, configuration changes may be detected, which require the model to be re-calculated.

The controller may be adapted to monitor changes in actual power over time, and to determine a correction factor relating to changes over time, and to re-apply the start-up phase and/or measurement phase when the correction factor reaches a threshold. This correction factor for example compensates for ageing or minor load variations.

In an extension, the controller may be further adapted to monitor the DC voltage and to adjust the set of duty cycles in response to a change in the DC voltage thereby to maintain a constant light output flux from the lighting arrangement. This approach may be used to alter the light output when voltage glitches or other artifacts are detected so that the changes in light output which result are rendered less visually perceptible.

The invention also provides a driver for a lighting arrangement of lighting elements of unknown electrical load, comprising:

a DC voltage source;

a switch arrangement for coupling the DC voltage source to the lighting arrangement, wherein the switch arrangement comprises a set of switches, each of which is for connection to a sub-set of the lighting elements;

a current sensor for sensing a current to the overall lighting arrangement; and a monitor as defined above.

This defines a lighting arrangement driver which incorporates the monitor device.

The invention also provides a lighting apparatus comprising:

a driver as defined above; and a lighting arrangement driven by the driver, wherein the lighting arrangement is user-configurable.

This user configuration means the load presented by the lighting arrangement is not known to the driver.

According to another aspect of the invention, there is provided a lighting method for providing lighting using an arrangement of lighting elements of unknown electrical load, comprising:

coupling a DC voltage source to the lighting arrangement using a switch arrangement which comprises a set of switches, each of which is for connection to a sub-set of the lighting elements;

controlling the switch arrangement using pulse width modulation to apply a set of duty cycles to the set of switches at the same time thereby to create a user-selected light output;

monitoring a current provided to the overall lighting arrangement within an individual duty cycle period to detect a plurality of current plateaus within the duty cycle period;

determining electrical characteristics or parameters of the lighting arrangement and of the power supply unit including at least a cable resistance between the power supply unit and the lighting arrangement and a power consumption downstream of the power supply unit based on the detected current plateaus and the set of duty cycles; and controlling the lighting arrangement based on the determined electrical characteristics or parameters.

This method uses only the overall current delivered to the lighting arrangement to derive the power consumption which may then be used to control the lighting arrangement. The power consumption estimate is made more accurate by determining at least the cable resistance.

Determining a cable resistance between the power supply unit and the lighting arrangement may comprise determining a cable resistance between the power supply unit and a lighting arrangement driver.

The electrical characteristics or parameters may further comprise a series resistance of each sub-set of lighting elements.

The method may comprise determining the current flowing through each sub-set of lighting elements based on an analysis of the set of different current levels.

A maximum duty cycle may for example be set for each duty cycle of the set based on the determined power consumption of the load and a load rating of the driver.

The method may comprise:

monitoring the current for a set of sequential individual duty cycle periods;

determining an average current for each plateau over the set of sequential duty cycle periods; and determining the power consumption from the average currents.

This averaging approach gives more accurate readings.

In order to prevent overload as soon as the driver is turned on the method may comprise, in a start-up phase:

applying a first set of duty cycles which is a scaled down version of a desired set of duty cycles and monitoring the current for an individual duty cycle period;

progressively increasing the scaling of the set of duty cycles; and deriving a moving average of the monitored currents.

These electrical characteristics or parameters enable the light output performance of the sub-set of lighting elements to be determined more accurately in response to a given set of duty cycle commands, and enable the overall power consumption to be determined more accurately.

The method may comprise monitoring the actual power delivered by the power supply unit over time, and reapplying the start-up phase and/or measurement phase when the monitored actual power exceeds a threshold relating to a maximum rated power.

The method may also comprise measuring the DC voltage for example to detect voltage glitches or other voltage artifacts. In this way, an overload situation can be detected. The monitored DC voltage may also be used to adjust the set of duty cycles in response to a change in the DC voltage thereby to maintain a constant light output flux from the lighting arrangement.

The invention may be implemented at least in part by software.

These and other aspects of the invention will be apparent from and elucidated with reference to the embodiment(s) described hereinafter.

BRIEF DESCRIPTION OF THE DRAWINGS

Examples of the invention will now be described in detail with reference to the accompanying drawings, in which.

DETAILED DESCRIPTION OF THE EMBODIMENTS

The invention provides a monitor device for monitoring a lighting arrangement of lighting elements of unknown electrical load, and a driver using the monitoring arrangement. A set of duty cycles is applied to switches which control sub-sets of lighting elements thereby to create a desired light output (i.e. desired by a user, and applied as a user input). With this desired duty cycle setting, the current for an individual duty cycle period is monitored, in particular to detect variations in a current plateau level within the individual duty cycle period. This is used to determine electrical characteristics including at least a cable resistance between a power supply unit and the lighting arrangement. An accurate estimation of the power consumption of the lighting arrangement (or more generally the load downstream of a power supply unit) may then be obtained. This avoids the need to probe the sub-sets of lighting elements individually in order to determine the nature of the load and its power consumption.

Figure 2:
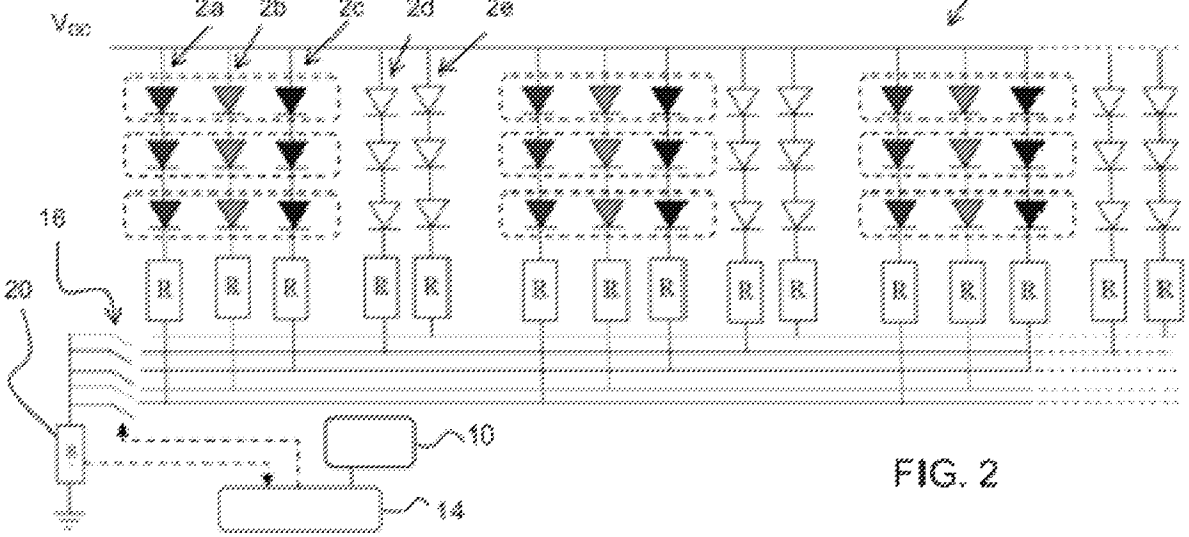
FIG. 2 shows the electrical schematic of a lighting system which may be configured and operated in accordance with the invention.

FIG. 2 shows the electrical schematic of a LED strip with 5 different colors. Each string 2*a* to 2*e* of LEDs is a set of LEDs of the same color and the strings connect to the same DC voltage source, such as 12V. There are five different string types, and multiple strings of each type. Together, all LEDs of one type (i.e. color) form a sub-set of lighting elements. Each sub-set has an associated switch within the set 16 of switches, so that all LEDs within a sub-set are controlled with a same duty cycle using a pulse width modulation (PWM) signal from the controller 14.

Depending on the supply voltage, a number of LEDs is put in series with a current limiting resistor R, or a current source or current sink.

Because a voltage source power supply is used, the LED strings are placed in parallel over the length of the strip. The strip can be cut and extended by adding or removing LED strings. FIG. 2 also shows that a current sense resistor 20 is used to measure the total current flowing.

LED strips typically come with a voltage source that is able to deliver a certain maximum power. Each LED strip extension represents a certain load and without any measures, the LED strip can only be extended up to a length the load of which can be supported by the power supply. If more load is installed than supported, the power supply and hence the LED strip product as a whole will stop functioning: the output voltage is reduced and the system will eventually stop working.

It is therefore a challenge to provide extendable LED strips as a result of this power limitation problem. Most LED strip products are typically provided with a power supply that is only able to supply the power to the length of the strip that comes with it. Overdesigning the power supply will introduce extra cost for the product that will not be used by the end-user if no extension is desired. If a longer strip is still desired, either the power supply needs to be changed or a completely new LED strip has to be installed.

The principle of a bus voltage architecture as used in a LED strip could also be used to define building blocks to be used in luminaires. This is especially beneficial in the case of luminaires with multiple light points that all behave in the same way. In that case, only a single power supply and controller is needed to address the multiple light points, which is a cost saving compared to equipping the luminaire with lamps that each consist of a communication module, power supply and LED module.

Since the appeal of the look and feel of a luminaire is very personal, the variety in luminaire look and feel is typically quite large while the production volume per luminaire type is low. It is therefore desirable to be able to apply the electronic building blocks (power supply, communication module, LED modules) as much as possible over the different luminaire types. Indeed, it is foreseen that the power supply and the communication module can be applied in many different luminaires. The diversity is expected to occur in LED modules. The reason for this diversity lies in the size of the light point required, the flux output and the color gamut that can be made (i.e. full color, tunable white light, fixed white).

Different LED boards require different settings in the software in the controller to properly control the LEDs. Diversity in software includes different LED parameters needed to accurately calculate color points to ensure good color consistency. In addition to color point and flux per primary, also thermal parameters like heat dissipation and thermal resistance are important to calculate the junction temperature of the LED and hence its flux and color point at that temperature.

If the electronic modules are supplied to luminaire manufacturers with limited knowledge of the electronics and software, it is very difficult to configure the software to obtain color consistent modules. Also, similarly to the LED strip example above, too many LED modules might be installed in the luminaire for the power supply to support, leading to a non-functioning luminaire.

Thus, the benefits of being able to provide a user configurable lighting load to a power supply applies both to modular luminaire designs as well as to lighting strips.

To detect (by the end-user or luminaire maker) that a LED load exceeds the capability of the power supply, one approach is for the product to probe the LED load each time it is powered.

The circuit of FIG. 2 may be used for this purpose. In particular, the sense resistor 20 means that the current drawn by the LED load is fed back to the controller 14. Since it is possible that the installed LED load is larger than that which the power supply can support, the measurement of the current drawn by the LEDs must be performed quickly because the capacitor in typical DC voltage sources are only able to support short current pulses that are many times higher than specified for stable operation.

This implies that the controller circuitry must be able to react fast to the PWM signal generated by the controller.

Figure 3:
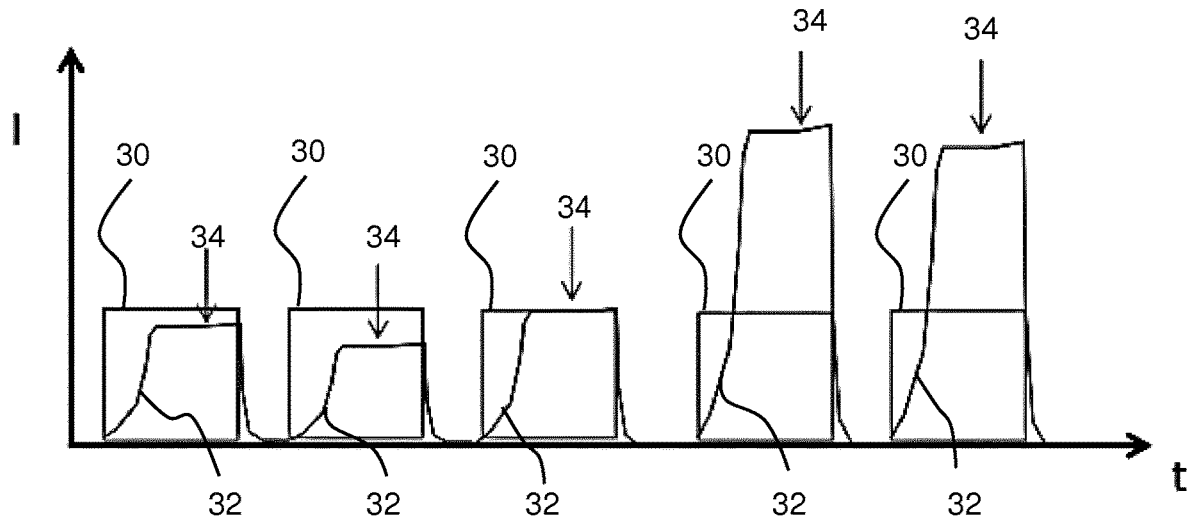
FIG. 3 shows one possible way to measure currents flowing through different sub-sets of lighting elements.

This issue is explained with reference to FIG. 3. It shows a drive signal 30 applied to the five sub-sets of lighting elements in turn, and the current measured across the current sensor resistor 20 is shown as plot 32. Samples are taken of the current level at the time instants shown by arrows 34.

In order not to draw too much power from the power supply, the time between application of the pulses and read out of the stable plateau value of the response should be small.

Each plateau value represents the total current drawn of all the LEDs connected to one particular switch, i.e. the sum of the currents in all of the parallel branches of the same type. It is thus related to the total power drawn by that sub-set of lighting elements. Due to the short pulse, this current plateau current can be many times higher than the maximum current the power supply can deliver under stable operation.

Figure 4:
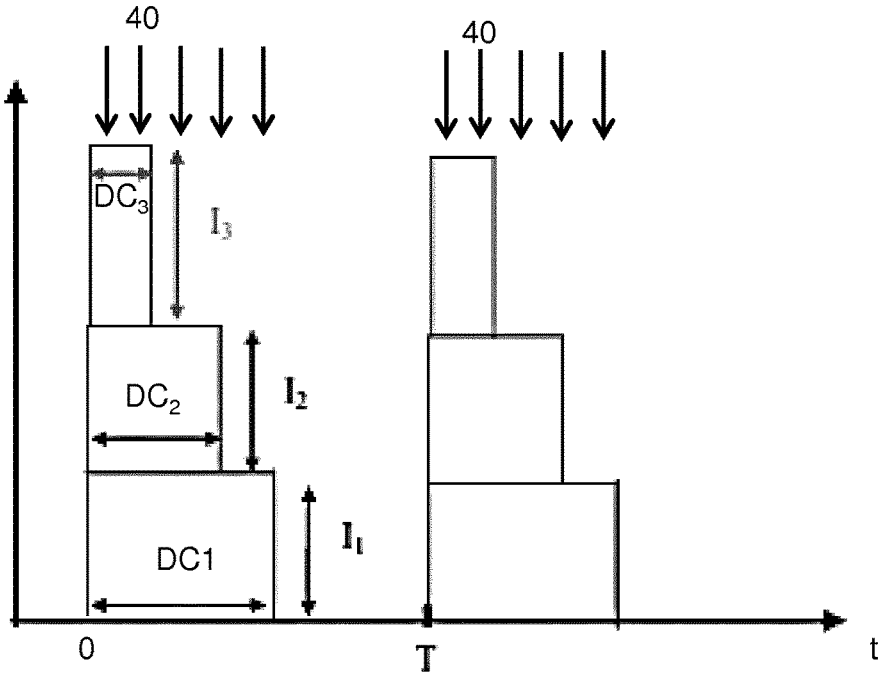
FIG. 4 shows the typical wave shape of a certain color point and dim level for a system with three channels.

FIG. 4 shows the typical wave shape of a certain color point and dim level for a system with three channels. Each channel has its specific duty cycle ($DC_i$) and its specific current contribution ($I_i$).

DCi is the duty cycle of channel i and $I_i$ is the current contribution of channel i derived at powering up.

With the current contribution per channel known, in normal operation, the software can calculate the power drawn from the LED load at a particular color point and dim level according to the formula below:

$$P_{calc}=V_{DC}\Sigma DC_i I_i \quad (1)$$

The power is thus related to both the individual (per sub-set of lighting elements) current contributions (which are not known since they depend on the nature of the load) and the individual (per sub-set of lighting elements) duty cycles (which are known). Thus, a single current measurement within the duty cycle period (i.e. the time from 0 to T) does not give sufficient information. This is why a separate measurement of each current level is needed. In essence, the area of the plot shown in FIG. 4 is to be calculated.

If the calculated power is larger than the rated power of the power supply, a reduction of all values of DCi may be applied according to:

$$DC\text{reduction}=P\text{rated}/P\text{calc} \quad (2)$$

In this way, the duty cycle of each channel is reduced to ensure that the rated power is not passed, and the power supply will not trip.

There are, however, disadvantages to this approach.

The applied pulse train may give rise to flashes visible to the human eye, leading to dissatisfied customers. The pulse train is needed because each sub-set of lighting elements is probed in turn. The sudden application of significant load such as these pulse trains shortly after power on of the power supply unit may lead to voltage drops of the power supply unit. Hence, there is a risk that the pulse train is measured at voltages lower than the nominal voltages, which could lead to a wrong load determination. This would make the load determination feature quite dependent on the robustness of the power supply and would introduce cost.

It is for instance known that high power factor single stage power supplies are susceptible to voltage drops in the case of sudden load application. This could be solved by increasing the pulse duration to give the power supply time to recover, but this will only lead to more pronounced flashing.

Figure 1:
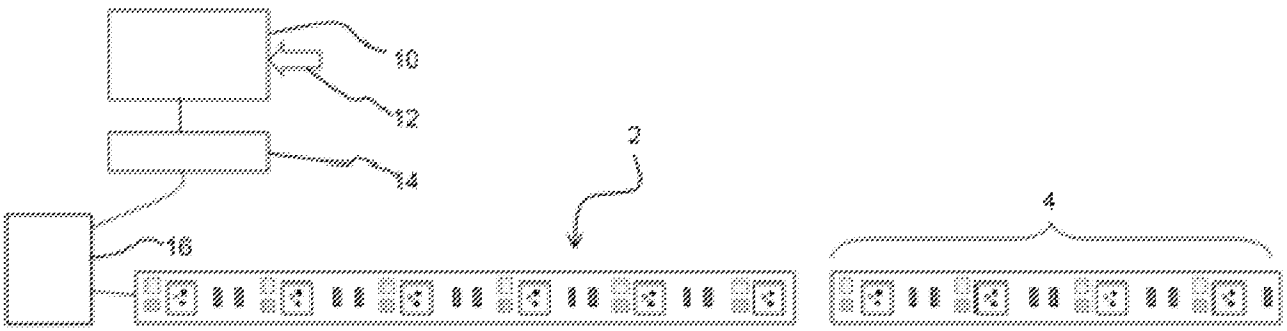
FIG. 1 Prior Art
FIG. 1 shows a typical LED strip architecture.

This invention makes use of an alternative procedure for load determination at start-up without visible flashing and avoiding rapid application of a large load. In addition, the procedure is used to determine electrical characteristics, in particular electrical characteristics of the lighting arrangement and the connections within the overall system, such as between the voltage source 10, controller 12 and lighting unit 2 (FIG. 1). This information may be used to make a more accurate estimation of the load.

The basic load determination functionality, which does not take into account electrical characteristics of the connections, will first be described.

The approach is based on starting up the light immediately at the intended color point therewith combining the different contributions of the different channels as shown in FIG. 4. Since the duty cycles of the different channels are known, a measurement of the heights of the different current plateau values is used to give a very accurate determination of the power according to formula (1) above.

Thus, within a duty cycle period, from 0 to T, a set of current measurements takes place. A set of measurement timings 40 is shown in FIG. 4.

There may be tens of measurements taken within the duty cycle period, for example 120 samples per 1 ms (1 kHz) period.

As explained above, if the power during the measurement is larger than the rated power of the power supply, all duty cycles can again be adjusted.

The approach can be implemented using the architecture shown in FIG. 2, essentially with a different functionality provided by the controller 14. Thus, the approach may be implemented as a different software solution for use in the controller 14.

The driver is again for a lighting arrangement 2 of lighting elements of unknown electrical load. A DC voltage source 10 is coupled by the switch arrangement 16 to the lighting arrangement 2. The switch arrangement comprises a set of switches, each of which is for connection to a sub-set 2*a*, 2*b*, 2*c*, 2*d*, 2*e* of the lighting elements. A current sensor 20 is for sensing a current to the overall lighting arrangement and a controller 14 controls the switch arrangement using pulse width modulation.

A set of duty cycles is applied to the set of switches thereby to create the desired light output. The plateau currents are sensed for an individual duty cycle period such that multiple current plateaus may be observed, and a power consumption of the lighting arrangement is then obtained. This avoids individually driving each sub-set of lighting elements. Monitoring takes place during an individual duty cycle period, so that the driver can react fast enough to a detected overload to prevent automatic shut off the DC voltage source. The DC voltage is also monitored to enable an overload condition to be determined.

The "desired light output" is typically a user-selected output color and brightness. This, it is not "desired" as part of a monitoring routine but has been selected independently of the monitoring process.

As explained above, knowledge is needed of multiple current plateau levels relating to the different sub-sets of lighting elements. These plateaus are measured by having multiple current sampling instants within the overall duty cycle period.

It could well be that the initial power before the measurement will exceed the rated power to such an extent or for such an amount of time that the power supply unit supply will fall into its over power protection mode and switch off.

To prevent this, it is desired to measure the plateau values very fast, as explained above in a single duty cycle period (i.e. at the PWM frequency) and already act on the power measurement in the next period. In this way, with a PWM frequency of 1 kHz, it would take 2 ms to tune back the power, which may be fast enough to prevent the power supply from adopting the over power protection. The downside of this solution is, however, that such a short period of measurement might lead to inaccurate results.

Taking an average current over multiple periods, possibly filtering out the ripple frequency of the power supply unit, may be used to provide improved accuracy. The plateau measurements remain in a single duty cycle period and the system can respond after each duty cycle period (for example by updating a moving average). However, the advantage is obtained that multiple such measurements are processed.

To prevent the power supply from falling into its over power protection mode due to this extended time duration, the averaging of the current plateau measurement may be performed during a ramp up of the light level. Such a ramp up will only impact the length of the duty cycles, not the height of the plateaus.

For example, by starting off with a ramp up of the light from a minimum dimming level to the maximum power within (for example) 50 ms of time both accurate values of the current plateaus are obtained without the risk of the power supply unit switching to its over power protection. A ramp up within 50 ms period is barely visible to the eye.

Each new set of plateau measurements obtained during a new period may then be put in a set of moving averages that becomes more and more accurate, while the system can still adjust the power on each update of the moving averages. Thus, the power consumption of the lighting arrangement is determined or updated at the rate of each duty cycle period.

Moreover, by gently increasing the load, the voltage of the power supply will have time to adjust its output voltage resulting in accurate measurements of the current contribution.

In one possible approach, during start-up, a ramp-up may be carried out from 0% to maximally 80% light output. During each 1 kHz period the current is measured at approximately 100 sampling instants, and during the last 10% of the duty cycle period, a quick voltage measurement is carried out. No current flows during this time because the intensity (and so maximum duty cycle) is limited to 80% so that each channel is set to zero.

In this way, the absolute power per period can be derived. The maximum ramp up intensity may then be controlled or limited. The maximum intensity may for example start to be actively limited within 10 ms.

Figure 5:
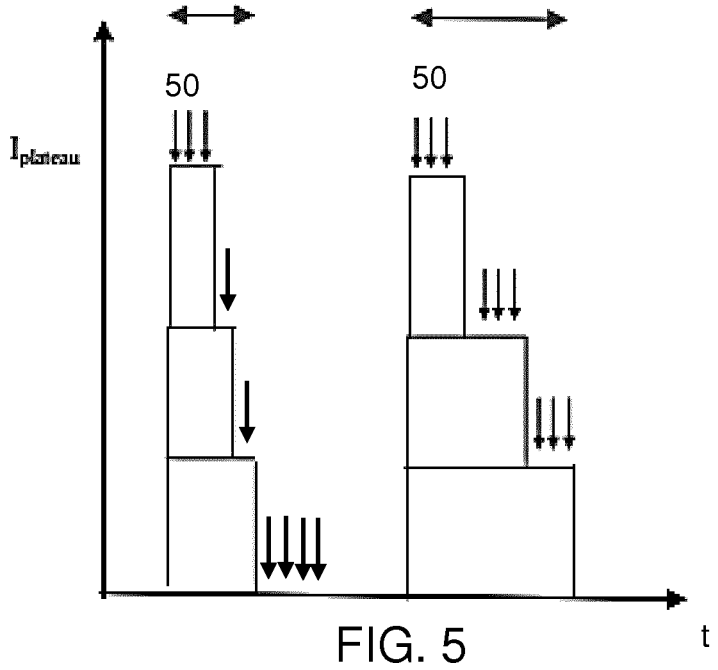
FIG. 5 shows an approach used in the system of the invention graphically.

FIG. 5 shows this general approach graphically.

The left stack of current plots is a first set of duty cycles which is a scaled down version of the desired set of duty cycles. For example it may comprise a 3% dimming level version of the desired combination of duty cycles. The current is then monitored for that individual duty cycle period.

The scaling of the set of duty cycles is progressively increased, for example as shown in the right stack of current plots (later in time).

FIG. 5 shows measurement timing instants as a set of arrows 50. The initial 3% dim level might be so low that not all plateau values can be measured.

FIG. 5 shows the limit when one measurement is obtained for the two lower plateaus. If the duty cycle is lower (and indeed FIG. 5 is exaggerated so that it shows a duty cycle much higher than 3%) the plateaus will be missed.

In such a case, the initial power estimation could be based on a single plateau measurement only. An overestimation of power could be made by multiplying the measured plateau value by the (known) longest duty cycle. As the duty cycle is increased, the individual plateaus become measurable as shown.

The monitoring may take place at start-up and optionally also when a transition to another color point is made.

Figure 6:
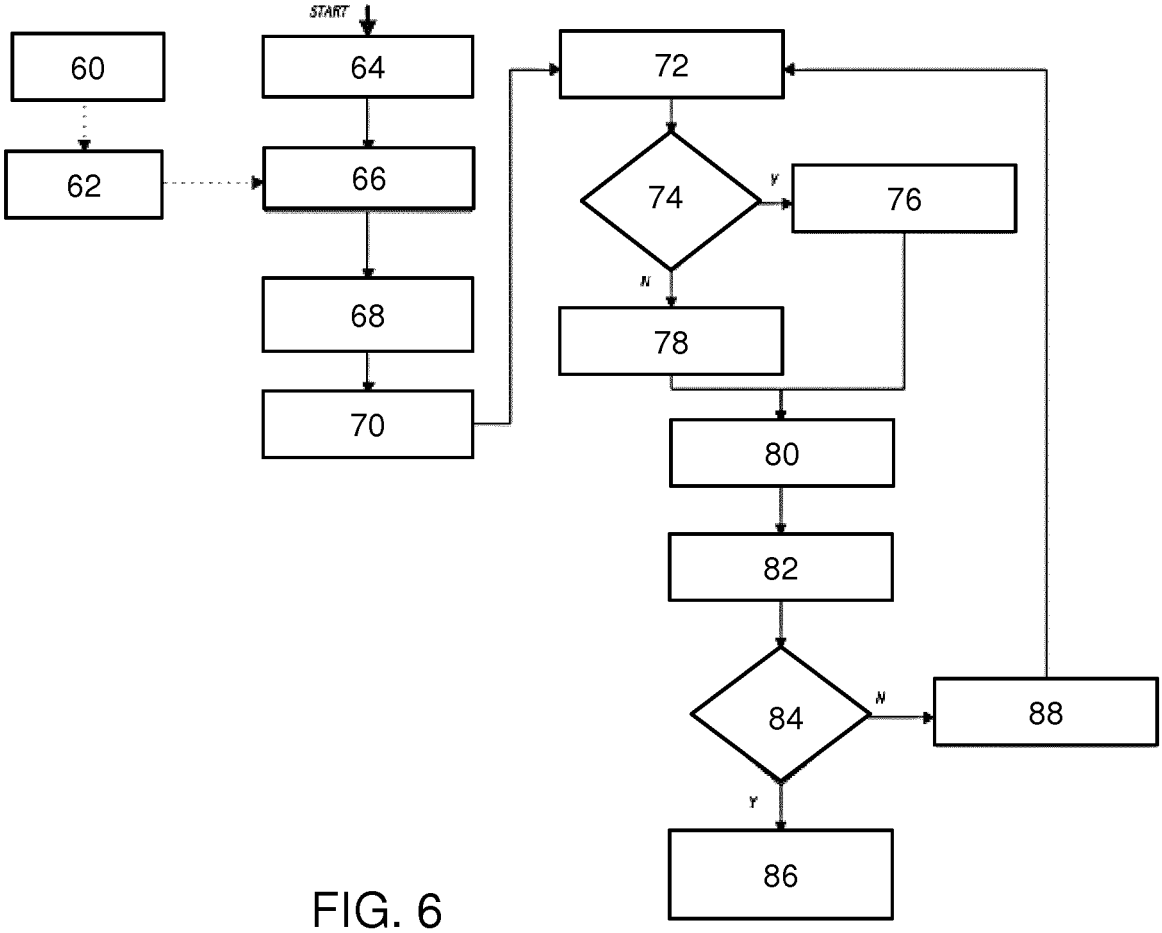
FIG. 6 is a flow chart showing one example of a control method.

FIG. 6 is a flow chart showing one example of the control method described above.

In step 60 the desired color point is input, and in step 62 it is converted to a set of duty cycles. Step 62 makes use of color model and outputs a ratio of duty cycles to get to the desired color point. This relates to the user setting a desired color point.

In step 64 the lamp is powered up.

In step 66 the duty cycles from step 62 are scaled to 3%.

In step 68 all possible current plateau values in the first duty cycle period are measured. In step 70 the load is estimated based on those measurements.

This load estimation is used to calculate a maximum duty cycle limit in step 72. This maximum is updated progressively as explained below.

In step 74 it is determined if the maximum duty cycle limit has already been reached. If it has, the duty cycles are all reduced in step 76 by the ratio between the determined load and the rated load of the power supply unit. If the maximum has not been reached, the duty cycles are all increased by 2% in step 78. Thus, after 50 cycles, the duty cycles will reach the original target levels unless they are throttled back.

In step 80, all possible plateau values in the next duty cycle period are measured. A moving average for each plateau value is then updated in step 82.

In step 84, it is determined if all 50 steps have been carried out (for a 50 ms startup cycle when operating at 1 kHz). If the 50 cycles are complete, the average plateau values are stored, and the lighting arrangement is controlled in steady state in step 86, using the resulting duty cycle levels.

If the 50 cycles are not yet complete, an updated load estimate takes place in step 88 which is then fed back to step 72 to enable updated maximum duty cycle information to be derived.

In an extension to this method, it is possible to derive and store the current contributions $I_i$ of the individual channels. In the example of the graph of FIG. 5 with a 3 channel system, all plateaus may have a long enough duration to be measured, and the contribution of all current values $I_i$ can be determined immediately after start-up of the lighting arrangement. However, a measurement will take a finite amount of time and if the difference in duty cycles is too small and the PWM frequency too high, it could be that some plateau values cannot be determined for certain colors (or combination of duty cycles). Hence, it could be that only a single or reduced set of plateau values can be measured. Clearly this depends on how many current measurements are made within the duty cycle period and the differences between the duty cycles of different channels.

As an approximation, calibration settings give information about the current ratios between the different channels, and this can be used to obtain an estimation of the current contribution of different channels. For greater accuracy, the routine can wait until the end-user sets the light to another color point (i.e. a different combination of duty cycles) until a new plateau value is long enough in order to be measured.

Another possibility is to adjust the color temperature setting during the 50 ms start-up period to make sure additional current plateaus can be measured. For example, the monitoring may start at a lowest color temperature (2200K) and during ramp up, move to 2700K (or even 3500K and then back to 2700K). This will not be visible by the eye but multiple plateaus can then be measured.

For a 3 channel system, there are 7 different combinations in which a plateau current can be built up. The below table shows the possible plateau levels as combinations of currents I1, I2 and I3.

| | Iplateau | | | | | | |
|---|---|---|---|---|---|---|---|
| | I1 | I2 | I3 | I4 | I5 | I6 | I7 |
| I1 | 1 | 0 | 0 | 1 | 1 | 0 | 1 |
| I2 | 0 | 1 | 0 | 1 | 0 | 1 | 1 |
| I3 | 0 | 0 | 1 | 0 | 1 | 1 | 1 |

If all of I1 to I7 are different values (which will be the case if I1, I2 and I3 do not have common multiples), then any three plateau measurements may be used to derive the three constituent components.

If there is only one plateau measurement when the lowest dimming setting is applied, the knowledge of the current ratios in the calibration settings may be used to derive an estimate. For example the single plateau measurement may yield I1+I2+I3, and the calibration settings may indicate nominal currents of I1=212 and I1=I3 for example. The three currents may then be obtained, but with some uncertainty.

Each time a plateau value can be determined, it can be stored in the table. As soon as 3 different plateau values are measured (assuming they relate to a unique combination of currents), there are 3 equations with 3 unknowns and all the individual current values Ii can be calculated with greater certainty. Once this stage is reached, the power of a new color point can be calculated based on formula (1).

For a system with even more primary colors, this becomes more complicated, but generally speaking, a lighting arrangement that has been switched to several color points for 50 ms during its life time is sufficient for the value of Ii to be determined. Thus, the table is completed over many operations of the lighting system, with different starting combinations of duty cycles.

Another advantage of this procedure is that the current values Ii can be updated after a certain period of time. It might be that due to temperature or aging of the LEDs, these values will start to deviate from the initial values. In the conventional way the determination of the current values Ii is only done at the power up of a light. If the connected light is always powered (for example by switching off the light by setting all PWM=0), these values would not get updated.

The approach above provides determination of the different currents drawn by sub-sets of lighting elements, in order to enable calculation of the power consumption.

The power consumption estimation may be made more accurate, in accordance with the invention, by additionally taking account of resistive losses in cables in the system, for example at least including a cable resistance between the power supply unit and the LED load, for example between the power supply unit and an intermediate LED driver.

Figure 7:
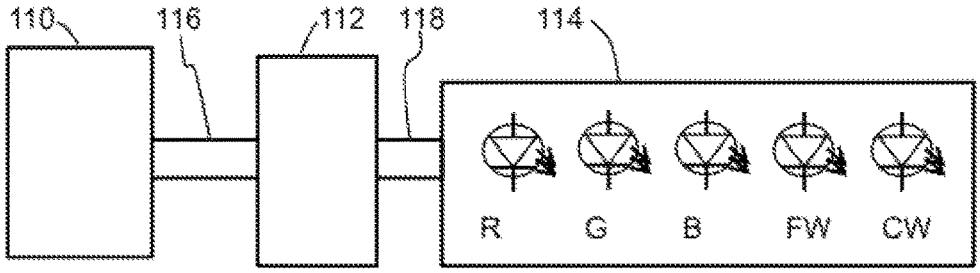
FIG. 7 shows the elements of a lighting system to show where long cables may be present.

FIG. 7 shows how a system may comprise a separate power supply unit 110, load driver 112 and LED load 114. Cables 116 and 118 connect the three modules. In this modular architecture, there may be different nominal power levels for different PSUs. In addition, there will be different loads with different numbers of channels connected to the load driver. Because of this, if the load changes or there are changes in the PSU, these changes should be detected so that the start-up sequence as explained above is retriggered to ensure the load is being driven to the maximum available power without the damaging the PSU. Furthermore, the start-up sequence may also be used to determine the cable resistances.

Figure 8:
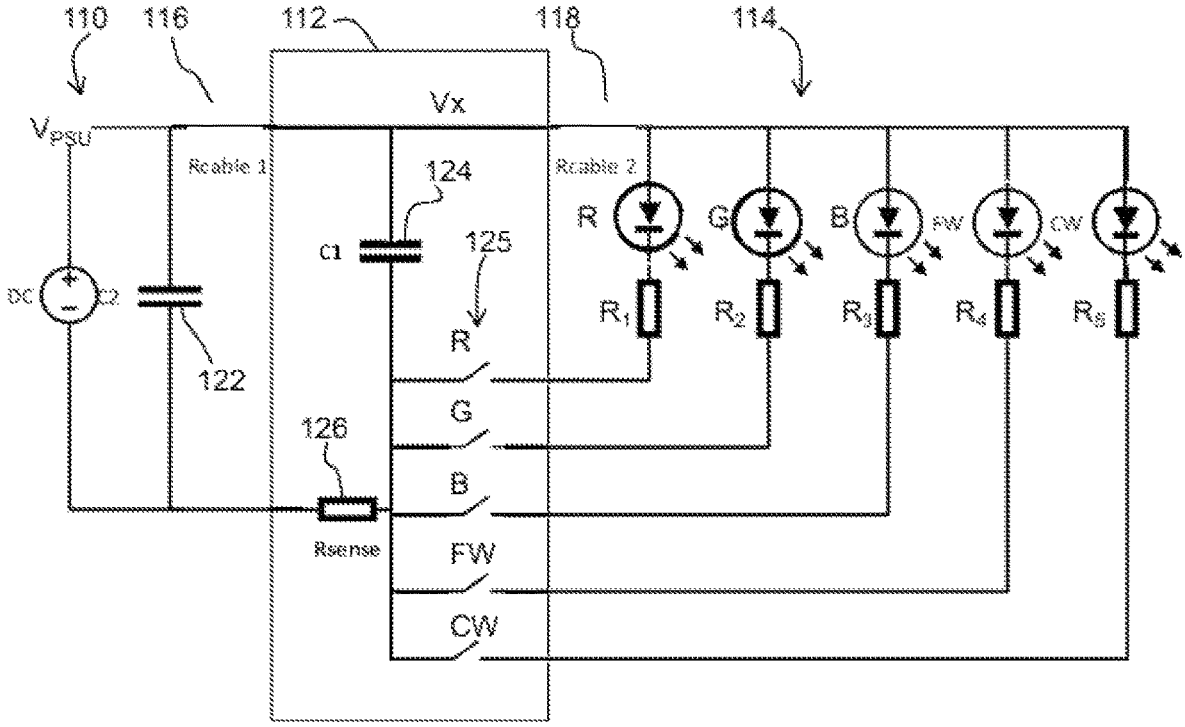
FIG. 8 shows the electrical components of the system of FIG. 7.

FIG. 8 shows the system of FIG. 7 in more detail. The power supply unit 110 is shown as a DC voltage source 120 delivering an output voltage $V_{PSU}$ (which is the desired bus voltage) and a parallel output capacitor 122. It connects via cable 116 with resistance Rcable1 to the load driver 112. This is represented as a parallel capacitor 124 of capacitance C1, and a set of switches 125 for each individual LED channel. In this example, there are five channels; channel 1 is red (R), channel 2 is green (G), channel 3 is blue (B), channel 4 is flame white (FW) and channel 5 is cool white (CW). There is a switch for each color in the set 125, as shown. The current sense resistor 126 is for sensing the full load current, with resistance Rsense.

The load driver 112 connects to the load by cable 118 with resistance Rcable2. Furthermore, each LED channel has a channel resistance, shown as $R_n$ where n is the channel number from 1 to 5.

In one example, which will be discussed in detail below, the start-up sequence described above is extended to generate estimates of Rcable1 and $R_n$ of each individual channel. The modeling is simplified to calculate the resistance values $R_n$ under the assumption that the forward voltage of the LEDs is known.

In this way, a more accurate power estimate is made possible. This improvement is for example particularly suitable when the resistance Rcable1 is dominant compared to Rcable2, i.e. the cable length from the power supply to the load driver is long compared to the cable length from the load driver to the lighting load. This version of the improved power estimation also does not take into account the capacitances C1 and C2. In other situations it may be preferred to determine the resistance Rcable2 in a similar manner and/or take into account the capacitance values. Thus, the approach described below may be extended to enable determination of additional electrical parameters or characteristics to those disclosed.

The resistor Rsense typically has a known value. Furthermore, this resistance only comes into play if there is so much LED load connected that the parallel LED resistors Rn become of the same order of magnitude as Rsense. If the LED load is much lower, then the resistors Rn are typically much higher and Rsense is negligible.

The resistance values may then be used to produce a more complete estimate of the power consumption for a given set of duty cycles.

Figure 9:
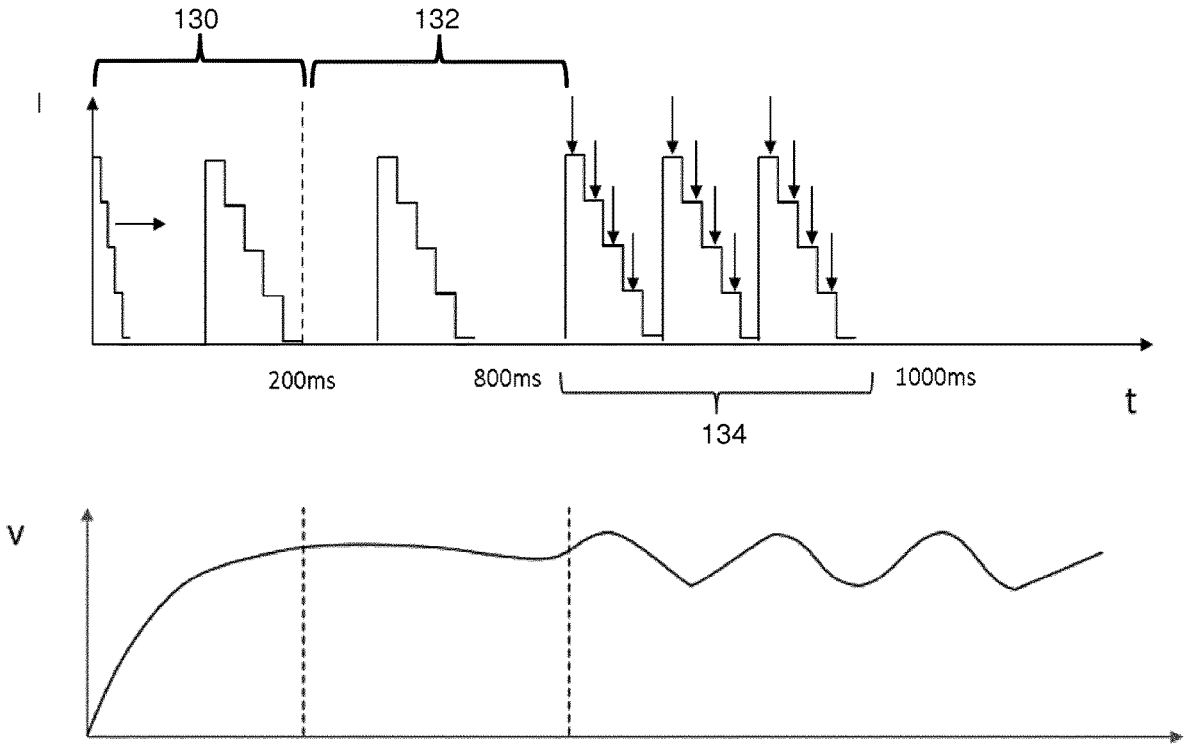
FIG. 9 shows a modification to the approach of FIG. 5 to include a monitoring phase during which electrical characteristics are obtained.

FIG. 9 shows an example of a complete start-up sequence but for a four channel system (to make the figure simpler). It shows the current provided to the LED load (I) and the load voltage (V).

It comprises a start-up phase 130 during which the duty cycles are gradually increased (but keeping the same proportions) in the same manner as explained above for the basic load determination functionality. During this time, the PSU power is ramped up, and voltage and current are monitored to prevent overpowering. As shown, there is then a stabilization phase 132 to ensure the output voltage of the power supply unit has stabilized. The start-up phase 130 for example has a 200 ms duration and the stabilization phase has a duration of 600 ms.

An AC to DC converter typically first rectifies the mains. For 50 Hz mains, this means that a ripple of 100 Hz is introduced, while for 60 Hz, it is 120 Hz. The period of 100

Hz and 120 Hz is 10 ms and 8.333 ms, respectively. A time period of 50 ms (as mentioned above) would capture 5 full periods of 100 Hz and 6 full periods of 120 Hz. Hence, this is the minimum time to average both frequencies and may be considered to be a principle value. A 200 ms start-up phase provides averaging over four of such principle values.

An additional measurement period 134 is then used to obtain a current and voltage profile for a period of multiple duty cycles, such as 200 duty cycles.

An average of 200 ms duration for the period 134 ensures that 100 Hz or 120 Hz ripple is filtered out.

FIG. 9 is a simplified representation, for example only showing a ripple during the period 134.

Figure 10:
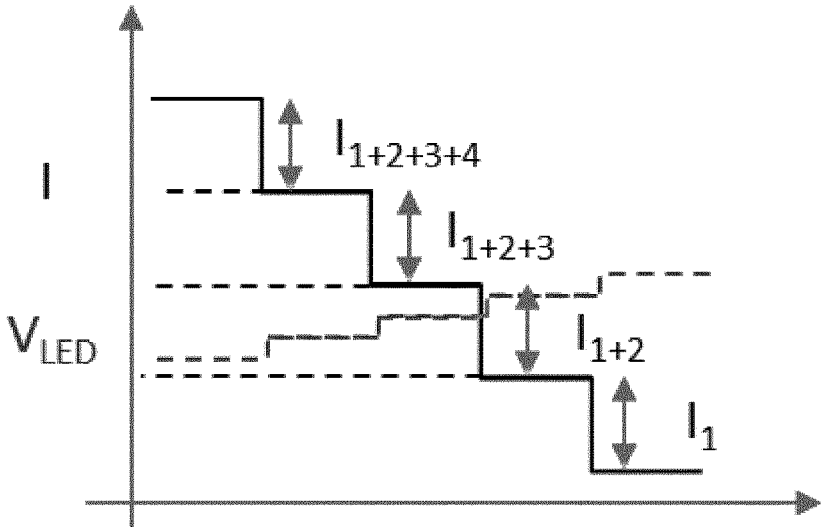
FIG. 10 shows the voltage and current measurement during one duty cycle period.

FIG. 10 shows the typical voltage and current measurements over time for one duty cycle, again for a four channel system. It shows the channels (1 to 4) to which the step currents flow. Thus, all four steps flow to channel 1, three of the current steps flow to channel 2 etc.

By measuring both current and voltages during the stepped waveform at start-up, the I-V relation can be obtained of the system, that can be described by:

$$V_{LED,plateau}=V_{PSU}-R\text{cable}\mathbf{1}*I_{plateau} \quad (3)$$

$V_{PSU}$ is the constant drive voltage delivered by the PSU. $V_{LED,plateau}$ is the voltage delivered by the load driver 112 during a current plateau (i.e. it is one of the steps of $V_{LED}$ shown in FIG. 12) and $I_{plateau}$ is the corresponding current. This relation does not take into account the second cable resistance Rcable2 so the voltage is not the voltage across the actual LED string, but also across the cable resistance Rcable2 and the resistors $R_n$.

This relationship enables Rcable1 to be determined.

As explained above, based on the measured current plateaus, the contribution of the individual LED channels is obtained. In addition, the resistance of the LED channels may be obtained as:

$$R_{total_n}=V_x/I_n \quad (4)$$

$R_{total_n}$ is a representation of the series resistance for channel n, which combines the series resistance $R_n$ and the complete string of LEDs, and $I_n$ is the current through that channel. The voltage Vx is measured at the load driver 112 and is shown in FIG. 8. The determination of the resistance $R_n$ can also be made closer to the actual value of the physical resistor $R_n$ by subtracting the LED string voltage from Vx.

The full set of current plateaus give a set of simultaneous equations from which all the $R_n$ values can be obtained. The solution starts from a single plateau, and in this way, the set of equations can be solved in a simple manner.

During normal operation, when a color change is requested, the model may be used to derive a new power estimate. As explained above, for a given set of duty cycles [D1 . . . Dn], it is known which LEDs are on for each plateau.

The equivalent resistance for each of the plateaus can thus be obtained, and because there is also an estimate of Rcable1, the total resistance observed by the PSU output $V_{PSU}$ is known:

$$I_{plateau,n}=(V_{PSU}-V_f)/R_{total} \quad (5)$$

Vf is the forward string voltage of the LEDs. It can be assumed that the forward voltages for all the different parallel strings are the same. This is a valid approximation as the variation of spreads of Vf is small.

$$R_{total}=R_{cable1}+R_{cable2}+R_{eq}+R_{sense} \quad (6)$$

$R_{eq}=1/\Sigma(1/R_j)$ with j being the active LEDs

A power estimate is then given by $$P_{estimate}=CF\cdot\Sigma(DC_n*I_{plateau,n}*V_{PSU}) \quad (7)$$

This power estimate includes a correction factor CF, described below. In the version of the system described in detail, the value $R_{cable2}$ is not considered.

The current Iplateau,n is associated with the total resistance Rtotal which is based on the resistors Rn in the active LED chains. This is explained further below.

Figure 11:
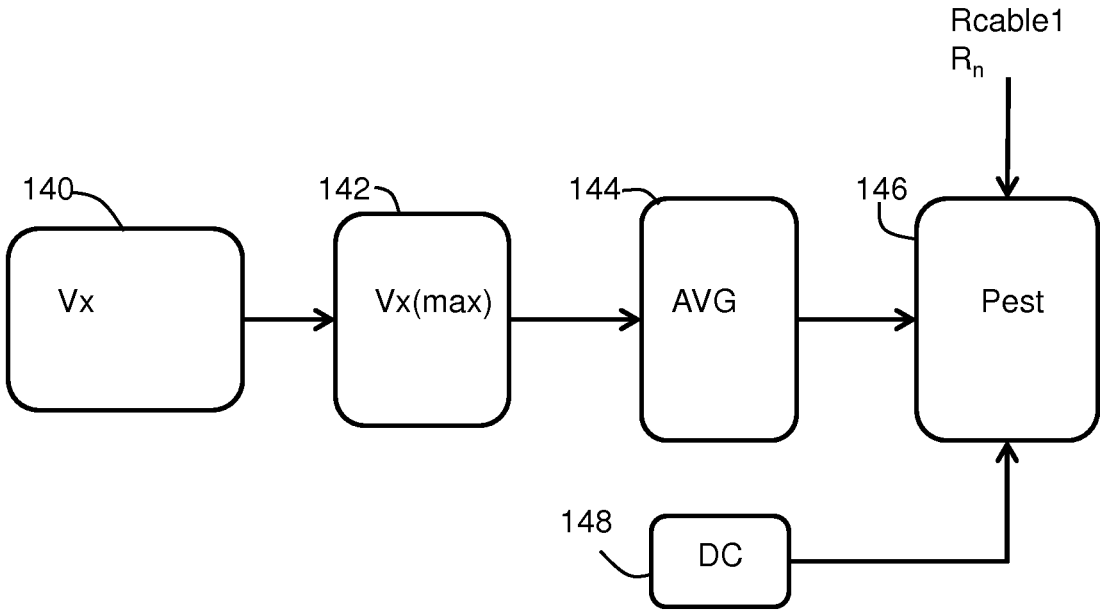
FIG. 11 shows a method of determining a power estimate.

FIG. 11 shows the power estimating method in more detail.

In step 140, the voltage Vx within the load driver is measured, as an output of an analog to digital converter. In step 142 a maximum value is calculated. This maximum value is the closest approximation of the output voltage $V_{PSU}$ of the power supply unit, which may be considered to be the bus voltage. If no current flows (for example during the start up period with a low duty cycle, there will be period of no current flow, and hence no voltage drop across the resistor Rcable1) the measured voltage Vx at the load controller will be equal to the power supply output voltage $V_{PSU}$.

In step 144, the a moving average of the maximum voltage is obtained, in order to average the mains ripple. This average value is provided as a first input to a power estimation computation of step 146.

The duty cycle settings are provided in step 148 to the power estimation computation, as well as the computed cable resistance Rcable1 and individual resistors $R_n$.

Using the value Vmax,avg and the value of the different resistors $R_n$, based on the duty cycle, it can be determined how many plateaus there are, which LEDs are on for each plateau and how long each plateau lasts. With this information, the resistance Req for each plateau can be determined and the current can be computed.

The information about plateaus is obtained by reconstructing the PWM shape from the duty cycle values. This reconstruction will depend on the type of PWM signals. For example, FIG. 9 shows a PWM structure in which duty cycles are all stacked from the left. They may be stacked from the right, or different duty cycle signals may be stacked from opposite sides.

Based on knowledge of the PWM approach being used, the duty cycle values enable the shape of the current waveform to be determined, and the current measurements at different timing instants can thus be associated with different combinations of active LED segments.

As explained above, once it is known which LEDs are on for each measured current plateau, a power estimate can be obtained as shown in the equations above.

The power estimate is based on calculating the total resistance $R_{total}$ which is present for each plateau and obtaining the power as the sum of the products of plateau current, voltage and plateau durations.

The plateau current is determined with knowledge of the LED string voltages Vf.

Note that not all combinations of current plateau values are measured. For example, only the staircase waveform shown in FIG. 9 is measured, which comprises a subset of plateaus such as:

Red
Red+Green
Red+Green+Blue
Red+Green+Blue+Flame white
Red+Green+Blue+Flame white+Cool white Hence, a combination of Red+Green+Flame white has not directly been measured.

The more channels that contribute (i.e. the higher the current peak), the more the voltage drop will be. By determining the resistance values from the measured current plateaus, a prediction of current peaks can be obtained. The resistances are independent of voltage drops so can be used for making an accurate prediction of the current peaks.

Note that FIG. 11 makes use of one specific way to calculate $V_{PSU}$. An alternative way is to calculate $V_{PSU}$=Vx+Iplateau,n*Rcable1, where Vx is the voltage at the time of the corresponding plateau.

As mentioned above and shown in the equation (7), the estimate is scaled with a correction factor CF.

Each time a new color setting is to be applied, a new power estimate is obtained, or else a calculation may be made periodically such as every second. The calculation is for example based on moving average current and voltage values over a 200 ms period.

The correction factor CF is updated based on measuring actual power and comparing with the estimated power. In this way, the correction factor is kept updated and the most recent value is used when a new power estimate is desired.

In this way, the system compares a predicted total power based on the known duty cycles to be applied and the model parameters which are obtained, with an actual total power consumption, in order to derive the compensation factor which takes account of temperature drifts and small load variations.

The scaling of duty cycles is then determined based on the corrected power estimate. The correction factor is calculated on a time scale of seconds. For example, the gap between the actual measured power and the estimated power should converge within around 10 seconds, so that the power supply unit is not overpowered for too long.

In a system with LEDs in series with a resistor, the current through the LEDs depends on the voltage over the LEDs. The voltage of the power supply unit minus the voltage of the LEDs is the voltage over the resistors as shown in the equation above.

As the system is in operation at full power, the LEDs heat up and the forward voltage of the LEDs will go down. As a result, the voltage over the resistor will increase and with that also the current through the LEDs. This deviation made is also compensated by the correction factor.

Normally, after a light is switched OFF and ON again, there is a substantial period of time in between to have cooled down the system. Under that assumption, the correction factor should not have changed due to the temperature, it is thus reset after power switching.

The measuring of actual power is also used to protect the power supply unit.

Figure 12:
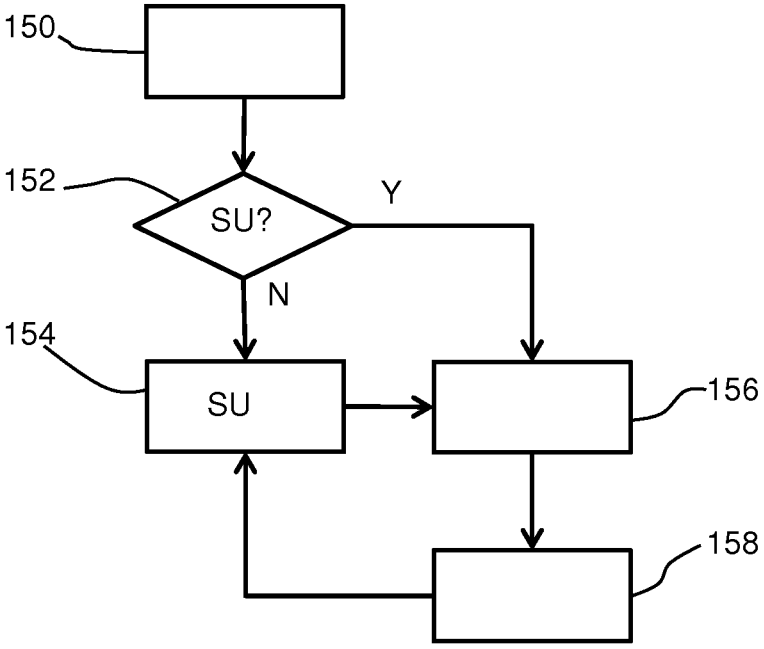
FIG. 12 shows a method for determining when to re-apply a start-up phase.

FIG. 12 is a flow chart to show how the start-up sequence is triggered.

In step 150 the system is powered on.

In step 152 there is a check if a start-up sequence has already been performed by checking a status flag. The start-up sequence is the full process shown in FIG. 9.

It there has not yet been a start-up sequence, it is carried out in step 154 following which the system proceeds to normal operation in step 156. It there had been a start-up sequence in step 152, the method also proceeds to step 156.

There is then a periodic check of load consistency in step 158. For no variation in load, the method returns to step 156, whereas the start-up sequence is re-triggered in step 154 in the event of a detected change in load.

The correction factor may also be used to trigger a repetition of the start-up sequence, i.e. step 148 may involve analysis of the correction factor.

First, when calculating the actual power, if it exceeds a threshold relating to the maximum power (i.e. if it exceeds a safety margin allocated to the rate maximum power) or if the correction factor exceeds a certain level (i.e. the difference between the estimated power and measured power is too large), the start-up sequence is triggered.

The start-up may for example be triggered by a parameter Max_threshold times the maximum power, where for example Max_threshold=1.2. Thus, slow drifts may be used to trigger a new start-up sequence based on the correction factor, or else a deviation between estimated power and measured power may be used.

The complete start-up sequence is triggered, giving a visible flash. This may be reduced by having the shortest measurement period of 50 ms.

One example of start-up sequence and calculation has been given above, but other sequences are possible.

This information obtained during the start-up sequence may be used for other purposes.

In low cost voltage-based lighting systems as described above, in which a resistor R is used to limit the current through the LED string, the stability of the light output is heavily dependent on the stability of the input voltage. Examples which may cause instability are ripple voltages, voltage dips by external factors like switching of neighboring heavy machinery or voltage fluctuations by the power supply itself due to load stepping, or control algorithms.

These voltage fluctuations may become visible in the light output. The approach above means the different current contributions are known. A change in voltage and hence current can be compensated by changing the set of duty cycles so that the light output remains unchanged.

The DC voltage may for example be 24V and this may fluctuate by 10%, i.e. 2.4V. If the resistors R in FIG. 2 take up 6V of the voltage supply, the current through the LEDs will change by 35% (2.4/6=0.35) assuming the change in voltage is taken up by the resistor.

Low cost power supplies of a single stage topology that comply with the high power factor lighting regulations typically do show significant voltage ripple up to +/−1V.

Moreover, other artifacts in the output voltage are also immediately visible in the light output. Examples are voltage steps due to abrupt increase/decrease of the mains input voltage, i.e. when heavy machinery in the neighborhood of the lighting device is switched ON or OFF, and voltage steps induced by the power supply itself. Some control ICs exhibit a high bandwidth (i.e. fast) regulation when the voltage is drifting away too much from the nominal voltage. If the voltage crosses a certain threshold, this high bandwidth control is started and the voltage is regulated back to nominal very fast. This also results in a step in the voltage.

Figure 13:
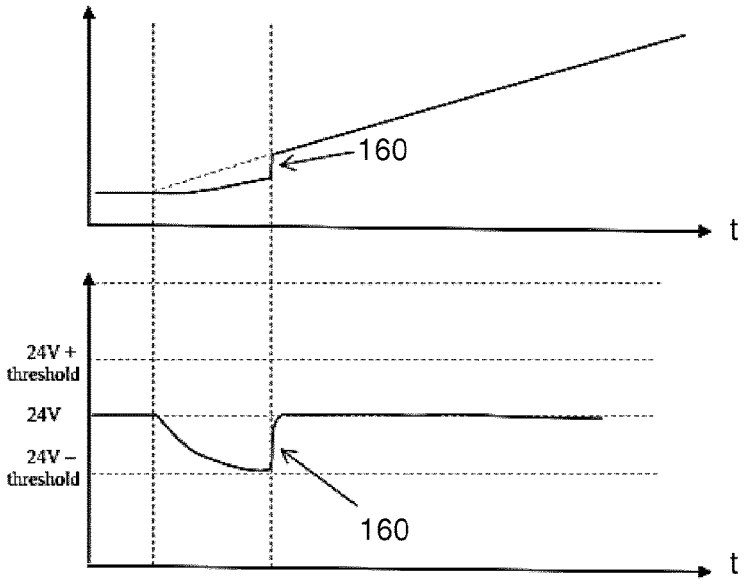
FIG. 13 is used to show the problem of a fluctuating supply voltage.

The effect of crossing of this threshold is shown in FIG. 13. The top plot shows the LED current against time. The bottom plot shows the voltage. When a threshold above or below the nominal value (24V in this example) is reached, there is fast corrective control at 90 which results in current step and hence visible light glitch at 160. Non-linearity of the light curve cannot be seen but the eye is quite sensitive to abrupt changes or steps in light output.

This type of artifact can be avoided by monitoring the total current that flows through all the LEDs and immediately acting on any deviation from the expected current based on the nominal voltage of the power supply.

The additional approach is to compensate the step in current by increasing/decreasing the duty cycles of all channels so that the average flux remains as constant as possible. The voltage/current step is not prevented (since it is desired as part of the protection control) but it becomes imperceptible.

Although it is the voltage of the power supply that is the source of the glitch in the light, the current is monitored (as explained above) because the light flux is directly related to the current. Moreover, a step in voltage is also easier to detect by measuring the current as a 10% change in voltage will result in a 35% change in current as shown above.

Because the light output is equal to the current times the length of a driving pulse, a dip in the plateau current may be compensated by an increase in the duty cycle according to below formula which shows the requirements for a constant flux φ:

$$\varphi = DC_{old} * I_{plateau,calc} = DC_{new} * I_{plateau,meas} \quad (8)$$

$$DC_{new} = DC_{old} * \{I_{plateau,calc} / I_{plateau,meas}\} \quad (9)$$

$DC_{old}$ is the previous duty cycle and $I_{plateau,calc}$ is the previously calculated plateau current. This would be a reference plateau value at the nominal voltage. $DC_{new}$ is the new duty cycle and $I_{plateau,meas}$ is the newly measured plateau current (caused by a change in the voltage).

Figure 14:
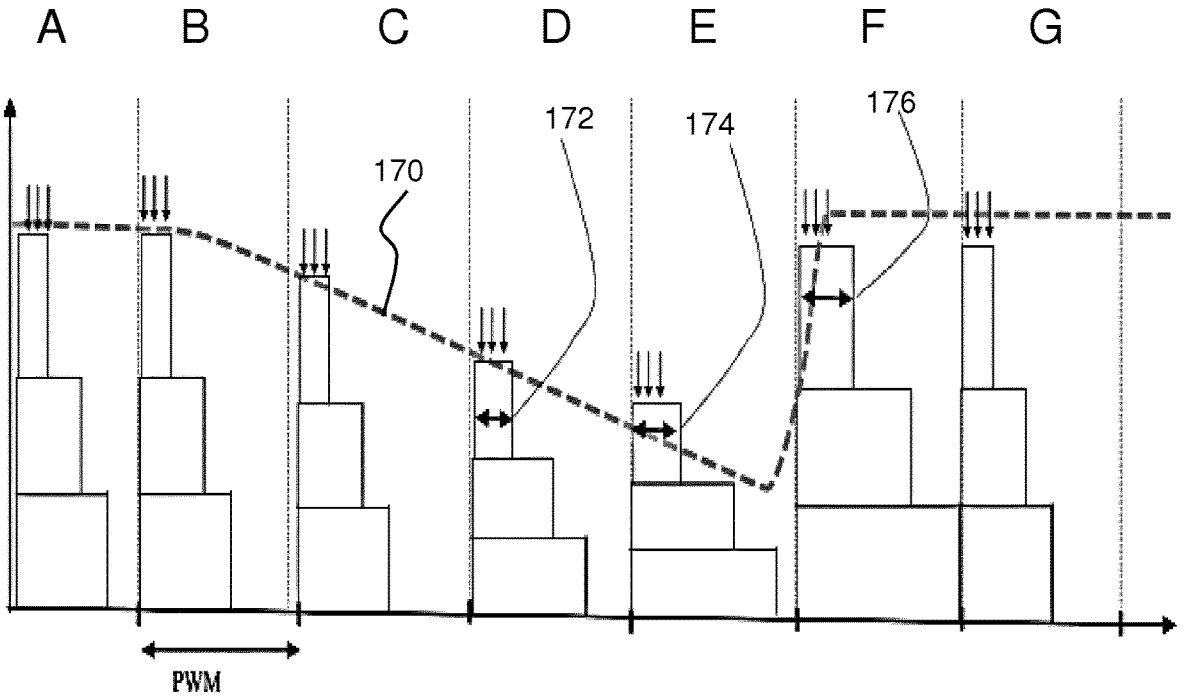
FIG. 14 shows a correction mechanism as a step-by-step sequence.

FIG. 14 shows the correction mechanism as a step-by-step sequence for better understanding. The voltage is indicated by line 170. Seven successive current waveforms are shown, labeled A to G.

At time A, the lighting arrangement is at a steady state.

At time B, there is the start of a voltage transition. The resulting current change is detected at time C.

At time D, the duty cycle is increased (as shown by arrow 172) and a further current drop is detected. At time E the duty cycle is again increased 174 and a further current drop is detected.

At time F, the duty cycle is increased 176 but the current returning to the nominal level is detected. At time G, the duty cycle is returned to the original levels corresponding to then steady state drive condition.

The compensation mechanism lags with 1 duty cycle period with respect to the actual signal.

The invention is of interest for systems where the customer (which can be an end-user or a lighting system commissioner) is able to attach different loads to a system with a fixed rated power of the power supply. The power supply is then a separate building block. Examples of these systems are LED strips that are end-user extendible or LED strips that are used as a building block in a luminaire. Alternatively, recessed spots or downlights that share a single driver and to which extra units can be added by the end user are another example.

As discussed above, a controller is used to perform the calculations explained. The controller can be implemented in numerous ways, with software and/or hardware, to perform the various functions required. A processor is one example of a controller which employs one or more microprocessors that may be programmed using software (e.g., microcode) to perform the required functions. A controller may however be implemented with or without employing a processor, and also may be implemented as a combination of dedicated hardware to perform some functions and a processor (e.g., one or more programmed microprocessors and associated circuitry) to perform other functions.

Examples of controller components that may be employed in various embodiments of the present disclosure include, but are not limited to, conventional microprocessors, application specific integrated circuits (ASICs), and field-programmable gate arrays (FPGAs).

In various implementations, a processor or controller may be associated with one or more storage media such as volatile and non-volatile computer memory such as RAM, PROM, EPROM, and EEPROM. The storage media may be encoded with one or more programs that, when executed on one or more processors and/or controllers, perform the required functions. Various storage media may be fixed within a processor or controller or may be transportable, such that the one or more programs stored thereon can be loaded into a processor or controller.

Other variations to the disclosed embodiments can be understood and effected by those skilled in the art in practicing the claimed invention, from a study of the drawings, the disclosure, and the appended claims. In the claims, the word "comprising" does not exclude other elements or steps, and the indefinite article "a" or "an" does not exclude a plurality. The mere fact that certain measures are recited in mutually different dependent claims does not indicate that a combination of these measures cannot be used to advantage. Any reference signs in the claims should not be construed as limiting the scope.

The invention claimed is:

1. A monitor device for monitoring a lighting arrangement of lighting elements, wherein the lighting arrangement is associated with a switch arrangement for coupling a DC voltage source originating from a power supply unit to the lighting arrangement, wherein the switch arrangement comprises a set of switches, each of which is for connection to a sub-set of the lighting elements, wherein the monitor device comprises:

a controller for providing control signals for controlling the switch arrangement using pulse width modulation, wherein the controller is adapted to:

apply a set of duty cycles to the set of switches at the same time thereby to create a user-selected light output;

monitor a current and a voltage at a plurality of times within an individual duty cycle period of the set of duty cycles thereby to detect a plurality of current plateaus within the duty cycle period;

determine electrical characteristics or parameters of the lighting arrangement and of the power supply unit including at least a cable resistance between the power supply unit and the lighting arrangement and a power consumption downstream of the power supply unit based on the detected current plateaus and the set of duty cycles; and control the lighting arrangement based on the determined electrical characteristics or parameters.

2. The monitor device as claimed in claim 1, wherein determine electrical characteristics or parameters of the lighting arrangement and of the power supply unit comprises the cable resistance between the power supply unit and a lighting arrangement driver; wherein determine the electrical characteristics or parameters further comprise a series resistance of each sub-set of lighting elements.

3. The monitor device as claimed in claim 1, wherein the controller is adapted to determine the current flowing through each sub-set of lighting elements based on an analysis of the set of different current levels.

4. The monitor device as claimed in claim 1, wherein the controller is adapted to adjust the duty cycles as a function of a user setting and as a function of the determined electrical characteristics or parameters.

5. The monitor device as claimed in claim 1, wherein the controller is adapted, in a start-up phase, to:

apply a first set of duty cycles which is a scaled down version of a desired set of duty cycles and monitor the current for an individual duty cycle period; and progressively increase the scaling of the set of duty cycles.

6. The monitor device as claimed in claim 5, wherein the controller is adapted, in a monitoring phase after the start-up phase, to determine the electrical characteristics or parameters.

7. The monitor device as claimed in claim 5, wherein the controller is adapted to monitor the actual power delivered by the power supply unit over time, and to reapply the start-up phase and/or measurement phase when the monitored actual power exceeds a threshold relating to a maximum rated power.

8. The monitor device as claimed in claim 5, wherein the controller is adapted to monitor changes in actual power over time, and to determine a correction factor relating to changes over time, and to reapply the start-up phase and/or measurement phase when the correction factor reaches a threshold.

9. A driver for the lighting arrangement of lighting elements, comprising:

the DC voltage source;

the switch arrangement for coupling the DC voltage source to the lighting arrangement, wherein the switch arrangement comprises a set of switches, each of which is for connection to a sub-set of the lighting elements;

the current sensor for sensing a current to the overall lighting arrangement; and the monitor device as claimed in claim 1.

10. A lighting apparatus comprising:

the driver as claimed in claim 9; and the lighting arrangement driven by the driver, wherein the lighting arrangement is user-configurable.

11. A lighting method for providing lighting using an arrangement of lighting elements, comprising:

coupling a DC voltage source to the lighting arrangement using a switch arrangement which comprises a set of switches, each of which is for connection to a sub-set of the lighting elements;

controlling the switch arrangement using pulse width modulation to apply a set of duty cycles to the set of switches at the same time thereby to create a user-selected light output;

monitoring a current and a voltage provided to the overall lighting arrangement within an individual duty cycle period of the set of duty cycles thereby to detect a plurality of current plateaus within the duty cycle period;

determining electrical characteristics or parameters of the lighting arrangement and of the power supply unit including at least a cable resistance between the power supply unit and the lighting arrangement and a power consumption downstream of the power supply unit based on the detected current plateaus and the set of duty cycles; and controlling the lighting arrangement based on the determined electrical characteristics or parameters.

12. The method as claimed in claim 11, wherein determine electrical characteristics or parameters of the lighting arrangement and of the power supply unit comprises the cable resistance between the power supply unit and a lighting arrangement driver; and/or wherein determine the electrical characteristics or parameters further comprise a series resistance of each sub-set of lighting elements.

13. The method as claimed in claim 11, comprising setting a maximum duty cycle for each duty cycle of the set based on the determined power consumption of the load and a load rating of the driver.

14. The method as claimed in claim 11, comprising during a start-up phase:

applying a first set of duty cycles which is a scaled down version of a desired set of duty cycles and monitoring the current for an individual duty cycle period;

progressively increasing the scaling of the set of duty cycles; and deriving a moving average of the monitored currents.

15. A non-transitory computer readable storage medium storing a computer program comprising computer program code which is adapted, when said computer program code is run on a computer, to implement the method according to claim 11.

* * * * *